US006257494B1

(12) United States Patent
Tokuoka et al.

(10) Patent No.: US 6,257,494 B1
(45) Date of Patent: Jul. 10, 2001

(54) BASE STRUCTURE OF A TURNOUT

(75) Inventors: Kenzo Tokuoka, Nishinomiya; Masafumi Demura, Kanazawa; Mitsuki Ego, Akashi; Yoshihiro Fukui, Kyoto; Takaaki Irie, Himeji; Tomokazu Yano, Himeji; Katsuniri Konishi, Himeji; Motoyoshi Maruyama, Himeji, all of (JP)

(73) Assignee: Yamato Kogyo Co., Ltd., Himeji (JP)

( * ) Notice: Subject to any disclaimer, the term of this patent is extended or adjusted under 35 U.S.C. 154(b) by 0 days.

(21) Appl. No.: 09/345,182

(22) Filed: Jun. 30, 1999

(30) Foreign Application Priority Data

Nov. 13, 1998 (JP) ..... 10-323860

(51) Int. Cl.[7] ..... E01B 13/00
(52) U.S. Cl. ..... 238/124; 238/27
(58) Field of Search ..... 238/27, 28, 29, 238/124; 246/415 R

(56) References Cited

U.S. PATENT DOCUMENTS 4,756,476 * 7/1988 Fasterding et al. ..... 238/27
5,222,662 * 6/1993 Floter ..... 238/27

* cited by examiner

*Primary Examiner*—S. Joseph Morano
*Assistant Examiner*—Robert J. McCarry, Jr.
(74) *Attorney, Agent, or Firm*—Marshall, O'Toole, Gerstein, Murray & Borun

(57) ABSTRACT

A base structure of a turnout, which has high durability and is capable of reliably preventing lateral displacement, is disclosed. The base structure of the turnout comprises a set of steel sleepers 1A, which is installed on the track bed and can be filled with ballast. The set of steel sleepers 1A comprises a plurality of steel sleepers 2*a*, 2*b*, 2*c* having a substantially same configuration and different lengths, which are arranged in parallel to each other at predetermined intervals with the length varying stepwise from the shortest steel sleeper 2*a* to the longest steel sleeper 2*c*, with end faces on both sides of the longitudinal direction of all steel sleepers are capped with sleeper tie members 3, 4, and 5 or 6, and a portion, or all, of the sleeper tie members are embedded in the track bed.

3 Claims, 13 Drawing Sheets

BASE STRUCTURE OF A TURNOUT

FIELD OF THE INVENTION

The present invention relates to a base structure of a turnout for a permanent way and, more particularly, to a base structure of a turnout capable of reliably preventing the occurrence of alignment deviation.

BACKGROUND OF THE INVENTION

For a base structure of a turnout for a permanent way, it is conventional to place wooden sleepers for the turnout in the track bed ballast at predetermined intervals and at right angles to the rail. Most sleepers used for the turnout are made of wood. Wooden sleepers are used because it is possible to place a base plate on the sleepers in the field, and to easily fix the base plate on the sleepers with track spikes or screw spikes by adjusting the position, then mount a rail on the base plate. Recently, sleepers made of synthetic resin or prestressed concrete are being used in place of the wooden sleepers.

Alternatively, a steel sleeper 21 having a cross section of substantially trapezoidal shape and a hollow inner space which opens at the bottom has been proposed, as shown in FIG. 12, wherein the inner space is filled with ballast to prevent the sleepers from subsiding, and both end faces of the sleeper in the longitudinal direction thereof are closed by press, thereby preventing the sleepers from moving in the direction of gauge, i.e., the so-called alignment deviation, by means of the ballast which fills the inner space of the sleeper.

The turnout comprises, as major components, a point section 22, a lead section 23, a crossing section 24 and a guard section 25, as shown in FIG. 13. In any one of these sections, rails 27 are mounted on the sleepers 26 with a positional relationship successively varying. Rails 27 and sleepers 26 are not at right angles with each other, and the crossing angle also is successively changing. The length of the sleeper also must be changed according to where it is positioned.

Thus, the turnout is very fragile because of its complicated structure compared to ordinary rail sections, and has shorter service life due to the use of wooden sleepers which tend to rot. More-over, sleepers used for a turnout generally are longer than the regular sleepers used in ordinary tracks, and, therefore, are more difficult to handle. Consequently, sleepers used for a turnout require more labor when being replaced.

Thus, it is very desirable to prevent damage or any other trouble from occurring to the sleepers to the utmost. However, a rail in a turnout has a radius of curvature which is generally smaller than in ordinary tracks, which causes a train running thereon to exert a sufficiently large lateral force that results in a displacement of the sleepers. As a result, it is necessary to frequently perform rail maintenance to correct the alignment deviation in order to prevent derailment accidents due to the alignment deviation.

In this respect, a conventional sleeper for a turnout provides a large resistive force to prevent the displacement in the longitudinal direction of the track by means of the ballast packed between the sleepers. However, with respect to the displacement in the direction perpendicular to the track, a conventional sleeper for a turnout provides a resistive force only with ballast built up on the track bed shoulder of both ends of the sleeper, which is not sufficient to prevent alignment deviation caused by a lateral force exerted on the track.

On the other hand, sleeper 21, as shown in FIG. 12, requires the ballast to be pressed toward the bottom of the sleeper by tamping the ballast from the side of the sleeper with a tie tamper in order to fill the inner space of the sleeper 21 with the ballast. This operation is very tedious and often results in insufficient packing of the ballast. Insufficient packing of the ballast leads to subsidence of the sleeper and poor resistance against a force exerted in the direction perpendicular to the track, which causes a displacement in said direction.

The present invention solves the problems of the above-described prior art, and an object of the present invention is to provide a base structure of a turnout which has high durability and is capable of reliably preventing lateral displacement.

SUMMARY OF THE INVENTION

In order to accomplish the above-described object, the first aspect of the present invention provides a base structure of a turnout used in a ballast track bed comprising a plurality of sleepers having substantially same configuration, but different lengths, wherein the sleepers are placed in parallel to each other, at predetermined intervals, such that the length of the sleepers changes stepwise from the short sleepers to the long sleepers. In addition, both end faces in the longitudinal direction of all the sleepers are capped with sleeper tie members, with part or all of the sleeper tie members being embedded in the ballast.

The second aspect of the present invention provides a base structure of a turnout used in a ballast track bed comprising a plurality of sleepers having substantially same configuration, but different lengths, wherein the sleepers are placed in parallel to each other, at predetermined intervals, such that length of the sleepers changes stepwise from the short sleepers to the long sleepers, and all the sleepers are tied each other by two sleeper tie members at positions located inward from both ends of the sleeper in the longitudinal direction thereof.

The third aspect of the present invention provides the base structure of a turnout of the second aspect, wherein the sleepers are tied each other by two sleeper tie members at positions located below rails.

According to the present invention, both end faces in the longitudinal direction of the plurality of sleepers of different lengths are capped with sleeper tie members, or sleepers are tied each other by two sleeper tie members at positions located inward from both ends of the sleeper in the longitudinal direction thereof, such that the plurality of sleepers act collectively as an integral base structure of a turnout. Therefore, the base structure of a turnout has a great resistive force against a force exerted in the direction perpendicular to the track, thus providing considerably greater resistance against an alignment deviation.

The third aspect of the present invention, where the sleepers are tied each other by two sleeper tie members at positions located below rails, has such an advantage that there is no portion which causes trouble when tamping the ballast beneath the sleeper with a tie tamper.

The sleeper tie members which tie a plurality of sleepers together are joined to the sleepers by means of track spikes, screw spikes, bolts and nuts, or welding, and the like.

DETAILED DESCRIPTION

Figure 1:
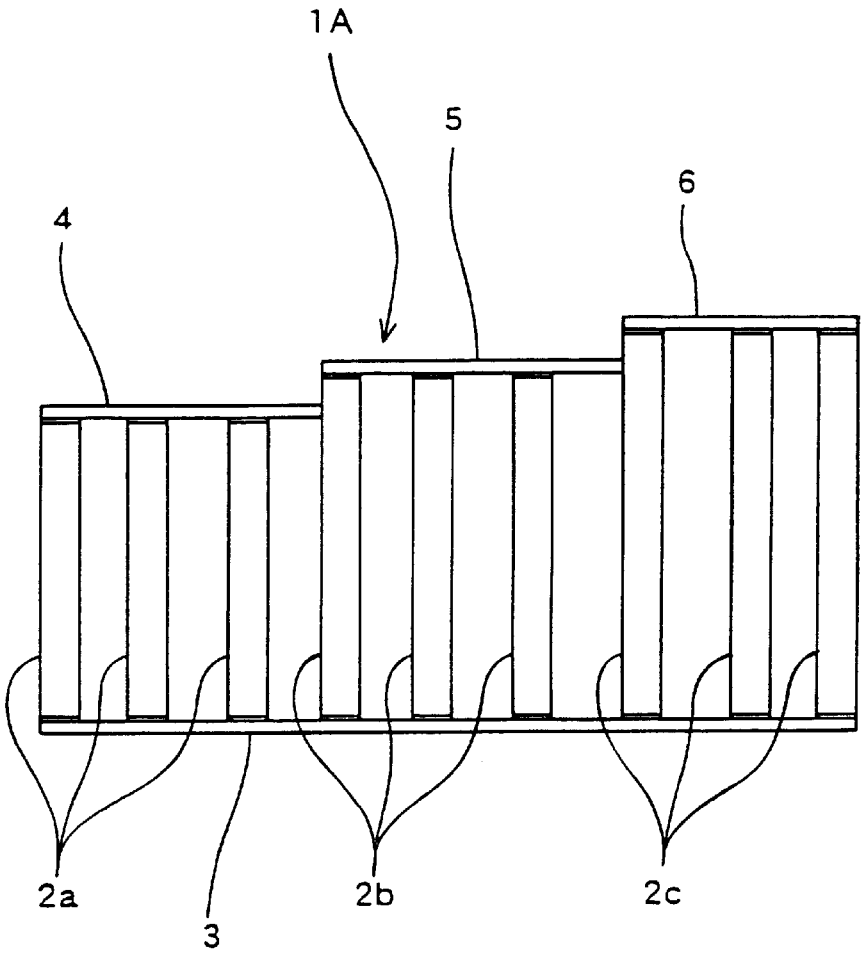
FIG. 1 is a plan view of an embodiment of steel sleepers which constitute a base structure of a turnout of the present invention, showing an embodiment where end faces on both sides of the longitudinal direction of the sleepers are capped with sleeper tie members.

Preferred embodiments of the present invention are described below with reference to the accompanying drawings. FIG. 1 is a plan view of a set of steel sleepers 1A which constitutes a base structure of a turnout according to a first embodiment of the present invention, where set of steel sleepers 1A comprise a plurality of steel sleepers of different lengths. Placed on these steel sleepers are turnout rails being fastened by means of elastic fastening device without using a screw or spike, for example, as disclosed in Japanese Unexamined Patent Application No. 10-114580, filed by the present applicant. In the case of FIG. 1, set of steel sleepers 1A comprises three steel sleepers 2*a* having the least length, three steel sleepers 2*b* having a medium length, and three steel sleepers 2*c* having the greatest length, which are arranged in parallel to each other at predetermined intervals in the longitudinal direction of rail, so that the 30 length of sleepers changes stepwise from the shortest steel sleeper 2*a* to the longest steel sleeper 2*c*. End faces on one side of the longitudinal direction of steel sleepers 2*a*, 2*b*, and 2*c* are all aligned in the same plane and capped with a sleeper tie member 3. End faces on other side of the longitudinal direction of steel sleepers 2*a*, 2*b*, and 2*c* are capped with sleeper tie members 4, 5, and 6, respectively. Steel sleepers (2*a*, 2*b*, 2*c*) and sleeper tie members (3, 4, 5, 6) are joined together by means of tie bolts (see numeral 12 in FIG. 2).

Figure 2A:
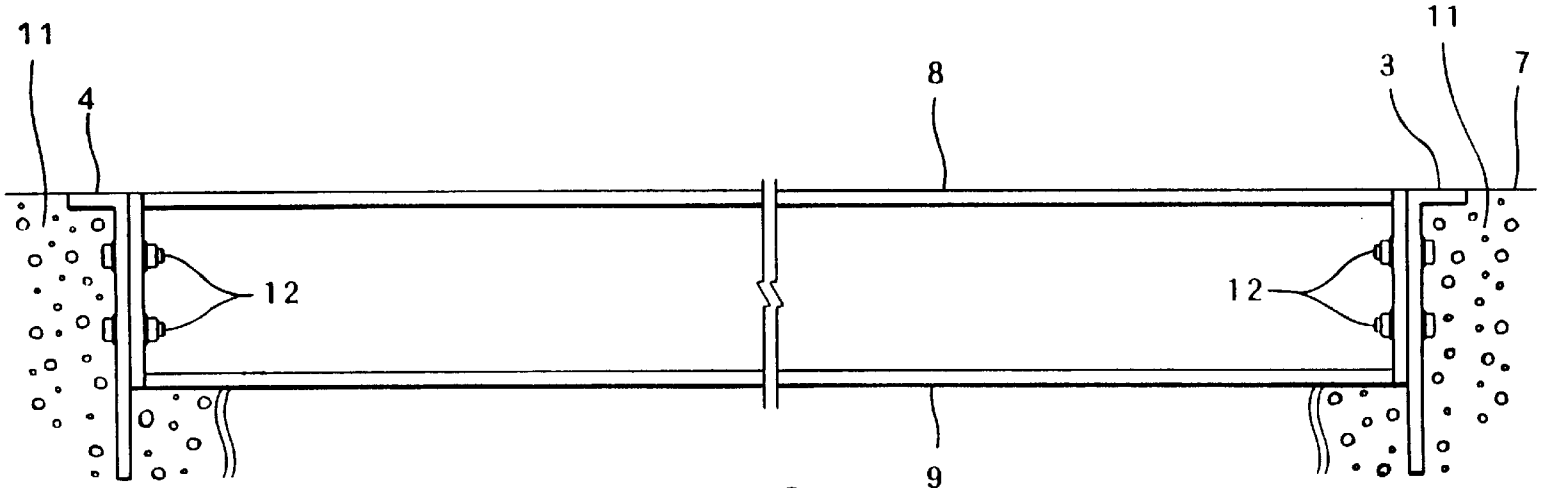
FIG. 2(*a*) is a side view of one steel sleeper constituting the steel sleepers of FIG. 1, and FIG. 2(*b*) is a plan view thereof.
Figure 2B:
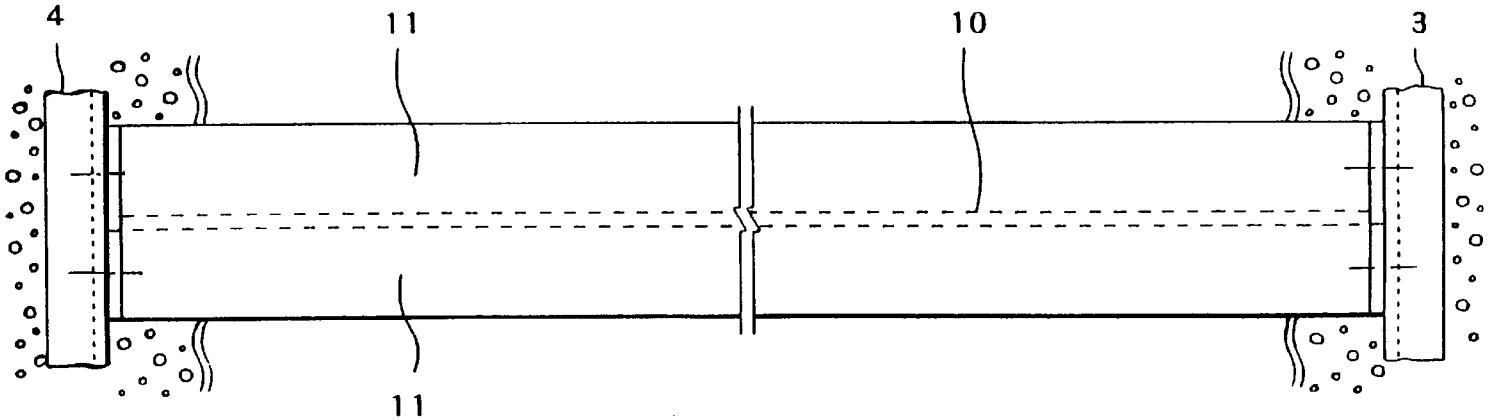

The steel sleepers have the same configuration except for difference in the length, as shown in FIG. 2. In FIG. 2, reference numeral 7 denotes a track bed. Each steel sleeper has a top flange 8 and a bottom flange 9, and a vertical web 10, which is formed to continue in the longitudinal direction of the sleeper, and connects top flange 8 and bottom flange 9 at the center in the direction of width thereof, such that the cross section in the direction of width of sleeper has a substantially I-shaped configuration. Sleeper tie members 3, 4 (or 5, 6) except for the top surfaces thereof are embedded in track bed ballast 11. The space surrounded by top flange 8, vertical web 10, bottom flange 9, and sleeper tie members 3, 4 is open to the outside on the side thereof, and forms a ballast packing space 11, which can be filled with ballast.

Figure 3:
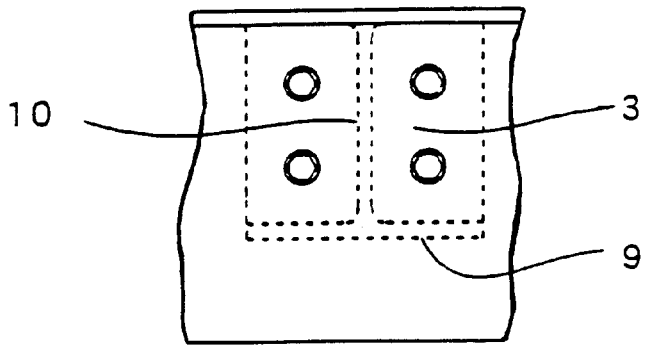
FIG. 3 shows an end face of the steel sleeper of FIG. 2.

Sleeper tie members act together with the ballast to resist a force exerted on the rail in the lateral direction, thereby preventing the steel sleeper from being displaced in the direction perpendicular to the track, namely preventing the alignment deviation. FIG. 3 shows an end face of the steel sleeper of FIG. 2.

Figure 4A:
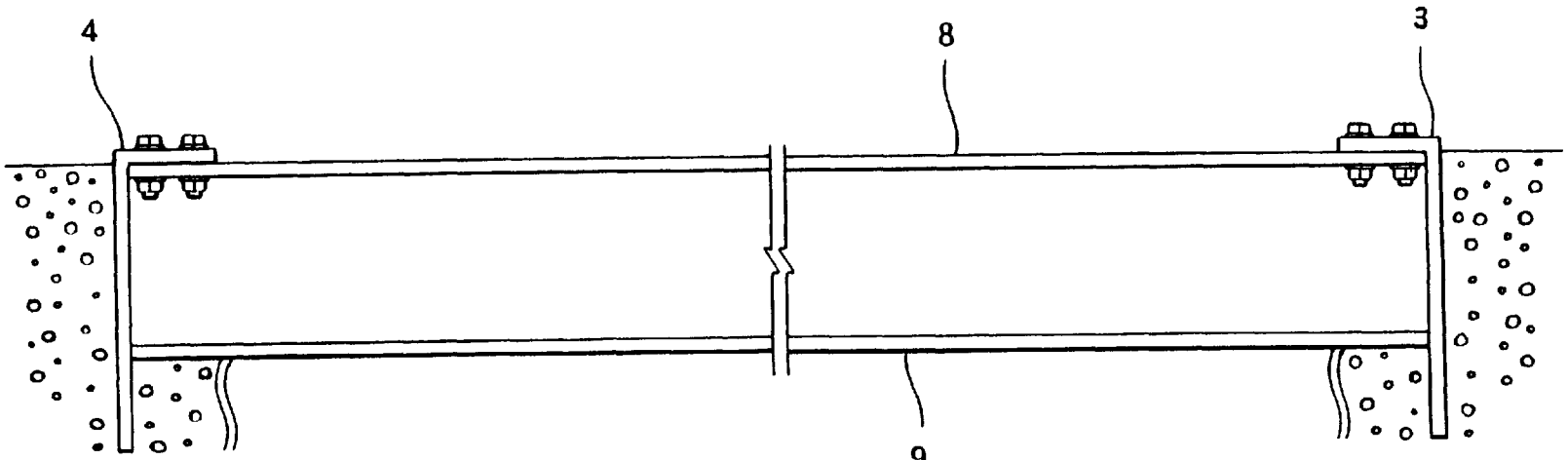
FIG. 4 shows a state of the sleeper tie members being joined to the sleeper by a different method from that of FIG. 2, FIG. 4(*a*) showing a side view thereof and FIG. 4(*b*) showing a plan view thereof.
Figure 4B:
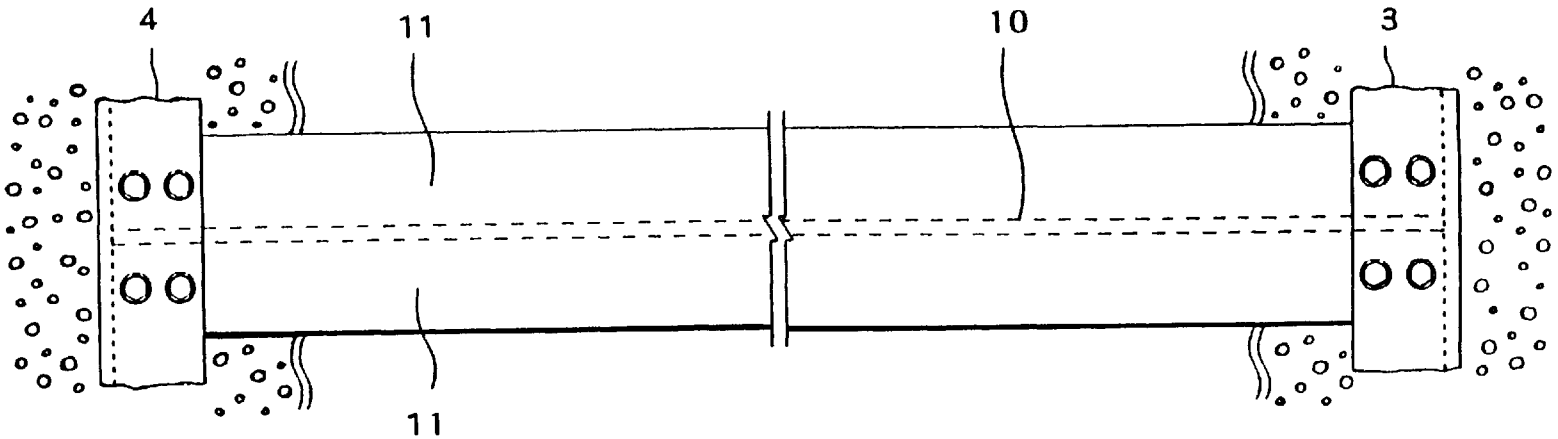

FIG. 4 shows another method of joining sleeper tie members 3, 4 to the steel sleeper, while FIG. 4(*a*) being a side view thereof and FIG. 4(*b*) being a plan thereof.

Figure 5:
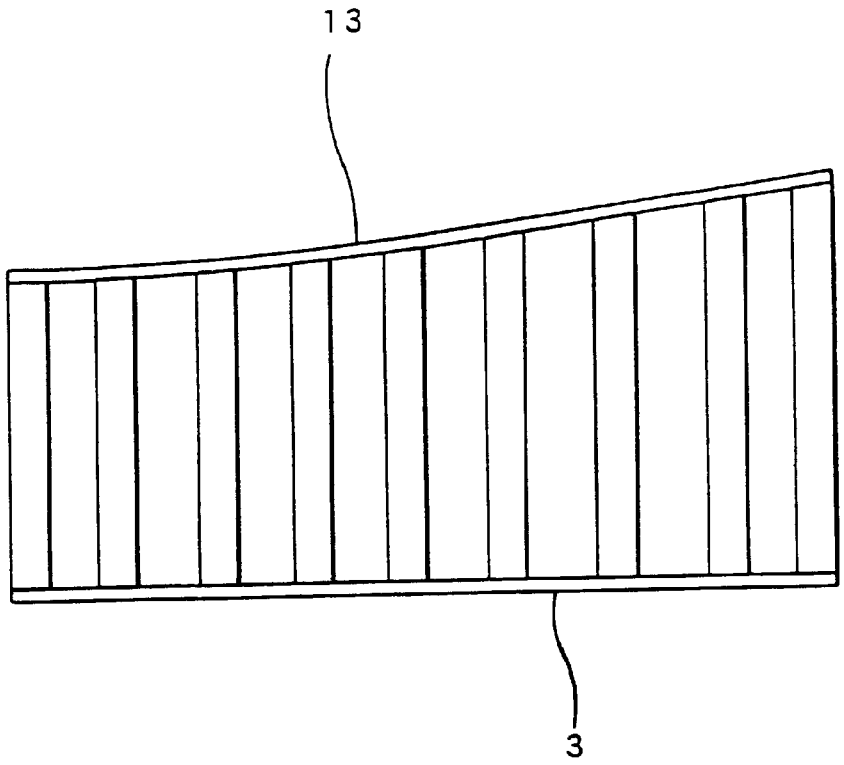
FIG. 5 is a plan view of an embodiment where end faces on both sides of the longitudinal direction of the plurality of sleepers are capped with a single sleeper tie member respectively.
Figure 6:
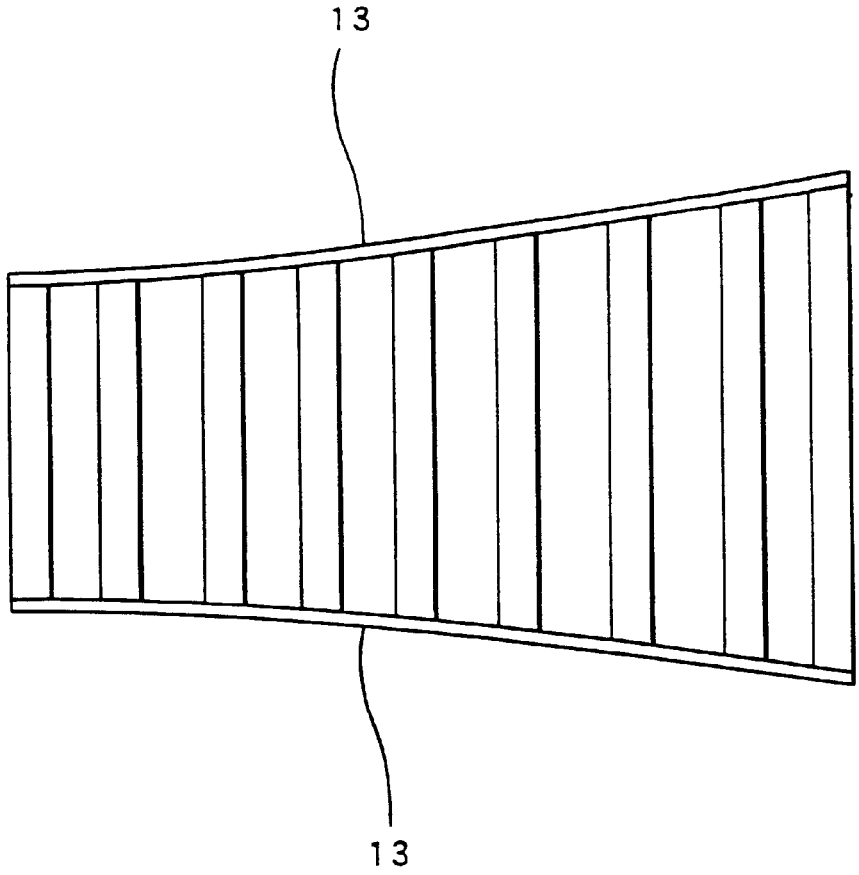
FIG. 6 is a plan view of another embodiment where end faces on both sides of the longitudinal direction of the plurality of sleepers are capped with a single sleeper tie member respectively.

FIG. 5 shows an example of a configuration wherein end faces on one side of the longitudinal direction of the steel sleepers of gradually increasing lengths are aligned on the same plane and capped with a single sleeper tie member 3, and end faces on other side of the longitudinal diection of the steel sleepers are capped with a curved sleeper tie member 13. Further, as shown in FIG. 6, end faces on both sides of the longitudinal direction of the steel sleepers of gradually increasing lengths also can be capped with curved sleeper tie members 13, 13.

Figure 7:
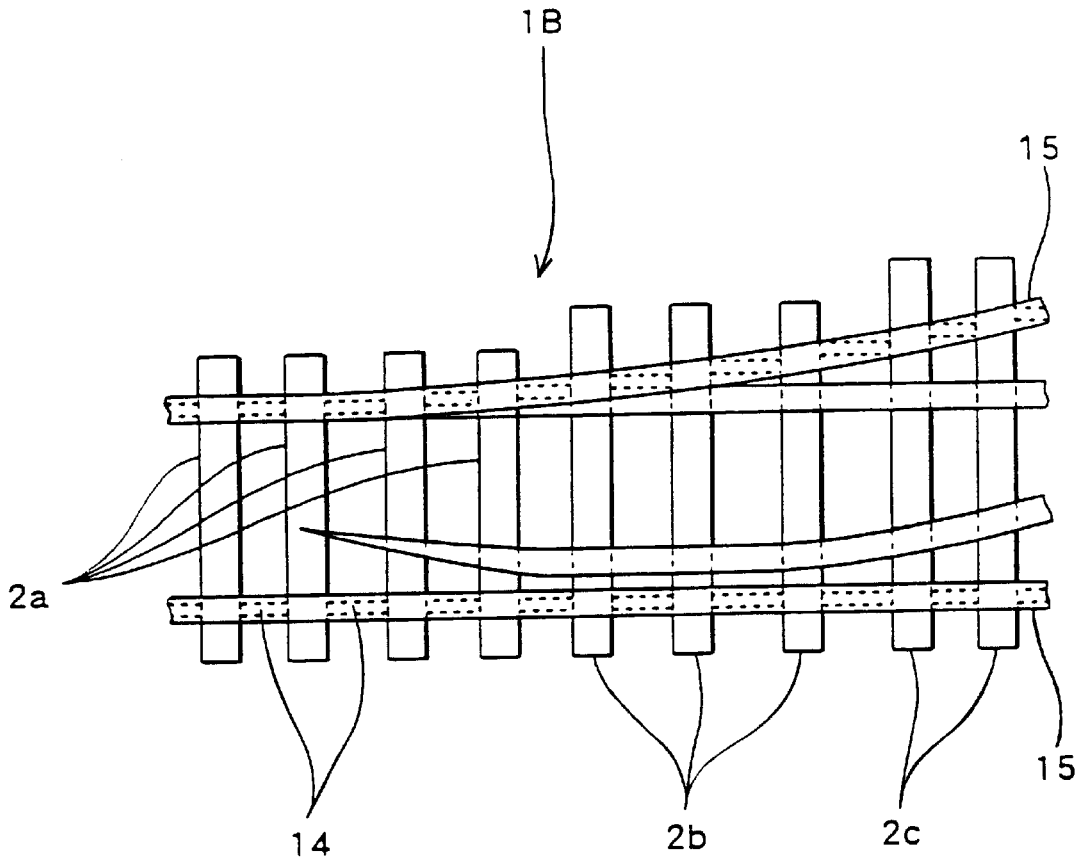
FIG. 7 is a plan view of another embodiment of steel sleepers which constitute the base structure of turnout of the present invention, showing a case where the sleepers are tied each other by two sleeper tie members at positions located inward from both ends of the sleepers in the longitudinal direction thereof.
Figure 8A:
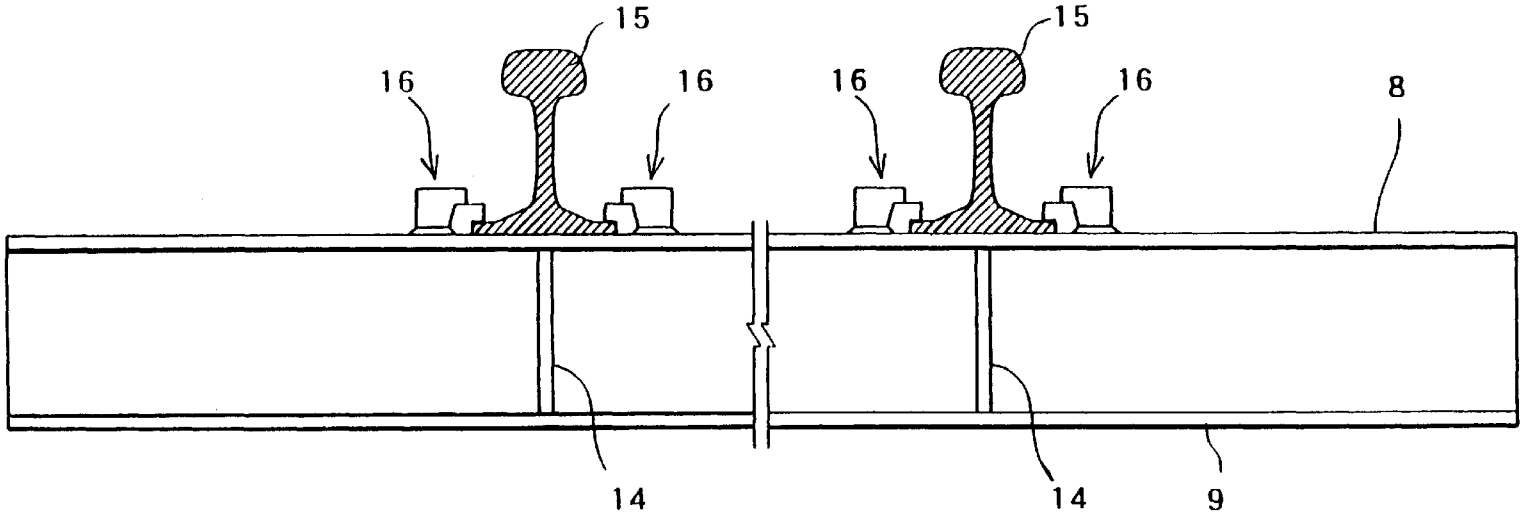
FIG. 8(*a*) is a left side view of the steel sleeper of FIG. 7, and FIG. 8(*b*) is a plan view thereof.
Figure 8B:
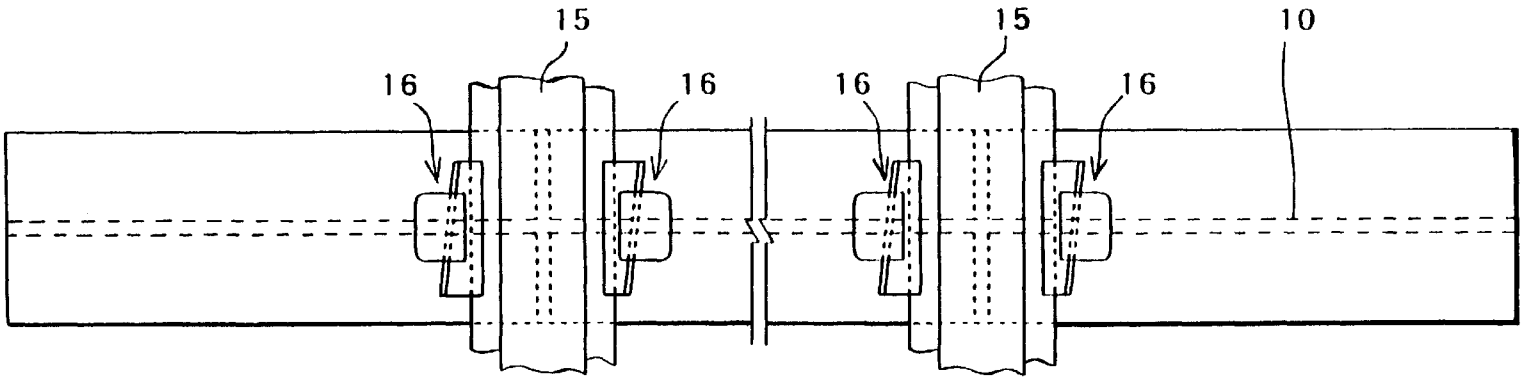
Figure 9:
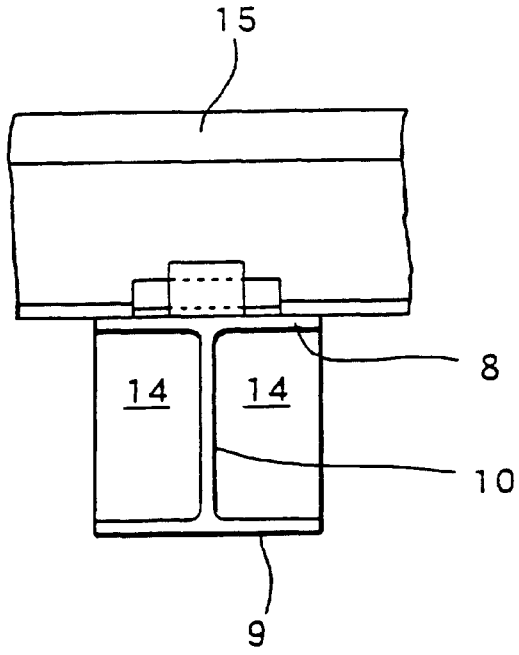
FIG. 9 shows an end face of the steel sleeper of FIG. 7.

FIG. 7 is a plan view of a set of steel sleepers 1B, which constitutes a base structure of a turnout of the second embodiment. This embodiment is different from the first embodiment in the position of the sleeper tie member. That is, the steel sleepers are tied each other by two sleeper tie members 14, 14 at positions located inward from both ends of the steel sleepers in the longitudinal direction thereof, and sleeper tie member 14 and steel sleepers (2*a*, 2*b*, 2*c*) are joined by welding. Sleeper tie member 14 is located below rail 15. FIG. 8(*a*) is a left side view of the steel sleeper of FIG. 7, FIG. 8(*b*) is a plan view thereof, and FIG. 9 shows an end face of the steel sleeper of FIG. 7.

In FIG. 8, numeral 16 denotes a rail fastening device which is omitted in FIG. 7 to make it easier to understand the method of fastening the sleepers with the sleeper tie members.

According to this embodiment of the present invention, since the cross section in the direction of width of steel sleeper has a substantially I-shaped configuration and the space surrounded by top flange late 8, vertical web 10, bottom flange 9, and sleeper tie members is open to the outside on the side thereof, ballast can be filled through the open side face, making it easier to fill the inner space of the steel sleeper with the ballast. As a result, greater resistance against a lateral force is ensured, thus achieving greater ability to prevent the steel sleeper from subsiding and being displaced in the direction perpendicular to the track. Particularly according to the present invention, since both end faces in the longitudinal direction of a plurality of steel sleepers of different lengths are capped with sleeper tie members, or the plurality of steel sleepers are tied each other by two sleeper tie members at positions located inward from both ends of the steel sleepers in the longitudinal direction thereof, the plurality of steel sleepers act collectively as an integral base structure of a turnout, and provides a very high resistance against a force exerted on the rail in the lateral direction thereof, thereby preventing an alignment deviation even when a great lateral force is exerted on the rails.

The present invention also has an effect such that, in cases where sleeper tie member 14 is located below rail 15, as shown in FIG. 7, there is no portion which causes trouble when tamping the ballast beneath the sleeper with a tie tamper.

While the cross section having substantially I-shaped configuration in the direction of width of steel sleeper is preferable as a constituent member of the base structure of a turnout of the present invention for being easily tied together, other configurations also can be employed as long as filling of the ballast is not impeded. It is important that the top flange is strong enough to bear a load transmitted from the rails because the rails are fastened on the top flange. The vertical web must be strong enough to bear the load transmitted from the top flange, since the vertical web connects the top flange and the bottom flange, and transmits the load from the top flange to the bottom flange. The strength of the top flange and the bottom flange can be ensured by employing a proper material and thickness.

Figure 10:
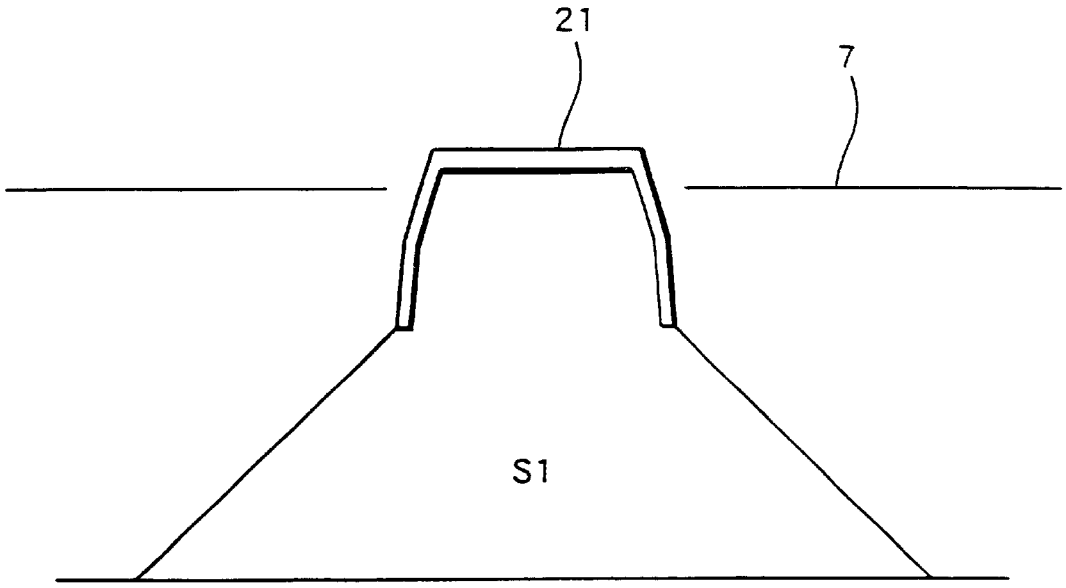
FIG. 10 is a drawing for explaining the action of the steel sleepers of the prior art.
Figure 11:
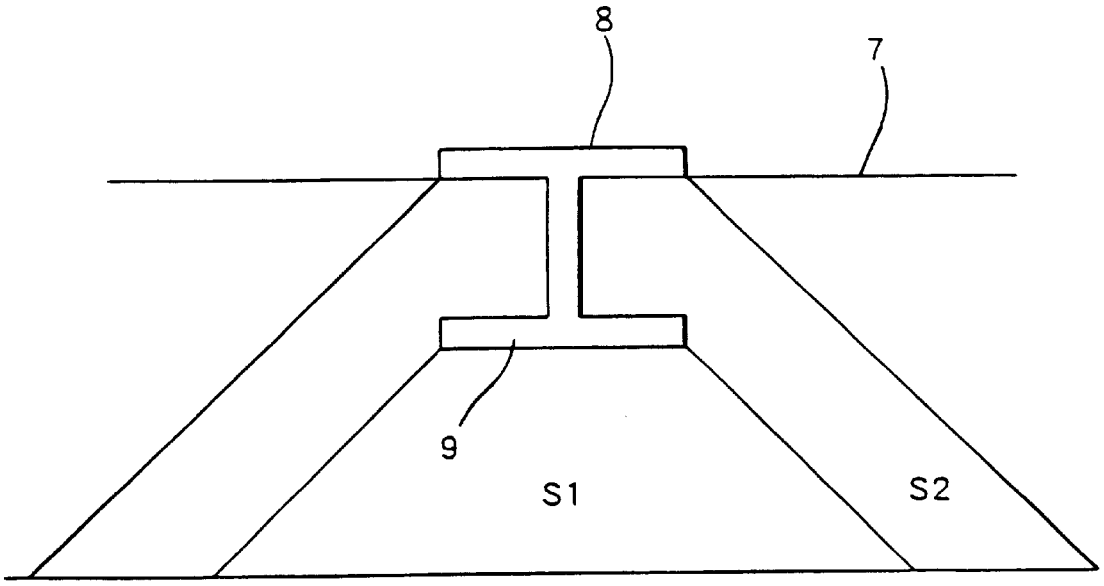
FIG. 11 is a drawing for explaining the action of the steel sleeper of the present invention.
Figure 12:
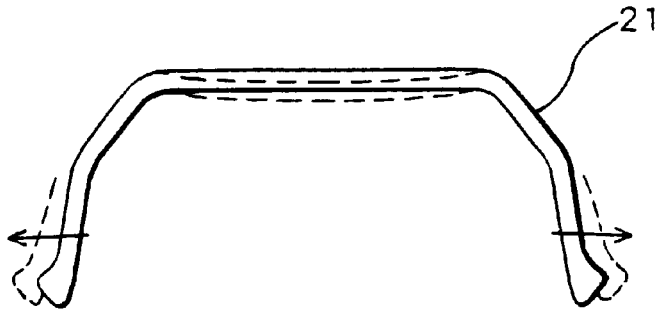
FIG. 12 is a cross sectional view showing an example of the sleeper of the prior art.
Figure 13:
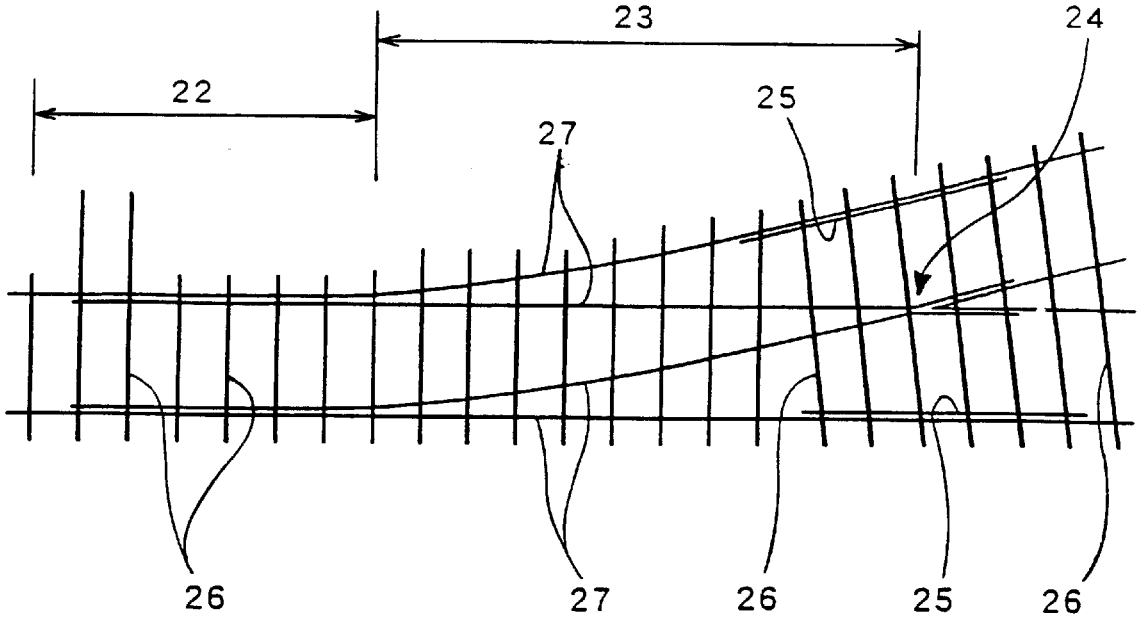
FIG. 13 is a schematic plan view of the turnout.

In cases where the end faces on both sides of the longitudinal direction of the steel sleeper are capped with the sleeper tie members, as shown in FIG. 1, the ballast packing space inside the sleeper is made greater than in the case of FIG. 7, and a greater amount of ballast is packed, thus achieving an increased ability to prevent the steel sleeper from subsiding, and prevent the steel sleeper from being displaced in the direction perpendicular to the track. In this regard, as shown in FIG. 10 illustrating the steel sleeper of the prior art, the ballast of track bed 7 receives a load from the steel sleeper in a region S1 which extends from the bottom surface of steel sleeper 21 at an angle of about 45 degrees on both sides of the bottom surface downward to the outside. In the case of a steel sleeper of the present invention, on the other hand, as shown in FIG. 11, because the spaces between top flange 8 and bottom flange 9 of the steel sleeper are filled with the ballast, the ballast of the track bed receives load not only from bottom flange 9, but also from top flange 8, and, therefore, the load carrying region of the ballast which receives the load from the steel sleeper becomes greater by the region S2, thus making it possible to prevent subsidence of steel sleeper more reliably.

While two sets of steel sleepers 1A, 1B which constitute the base structure of turnout comprise steel sleepers of different lengths in the above-described embodiments, the variety of lengths and the number of steel sleepers are not limited to those of the embodiments, and can vary depending on the turnout, as a matter of course.

The base structure of a turnout of the present invention has a very high resistance against a lateral force exerted on the rail, and a considerably increased capability of preventing alignment deviation because the plurality of steel sleepers tied to each other by the sleeper tie members act collectively as an integral base structure of a turnout. When the sleepers are tied each other by two sleeper tie members at positions located below rails, as in the third aspect of the present invention, in particular, an effect can be obtained such that there is no portion which causes trouble when tamping the ballast below the sleeper with a tie tamper.

What is claimed is:

1. A base structure of a turnout used in a ballast track bed comprising a plurality of sleepers having a substantially same cross section configuration, but a different length, wherein the sleepers are positioned in parallel to each other at predetermined intervals, such that the length of the sleepers changes successively from short sleepers to long sleepers, and both end faces of all the sleepers, in the longitudinal direction, are capped with sleeper tie members, with a portion of or all of the sleeper tie members being embedded in the ballast.

2. A base structure of a turnout used in a ballast track bed comprising a plurality of sleepers having a substantially same cross section configuration, but a different length, wherein the sleepers are positioned in parallel to each other at predetermined intervals, such that the length of the sleepers changes successively from short sleepers to long sleepers, and all sleepers are tied to each other by two sleeper tie members at positions located inward from both ends of the sleeper and in the longitudinal direction thereof.

3. The base structure of claim 2 wherein the sleepers are tied each other by two sleeper tie members at positions located below rails.

* * * * *